US005461957A

United States Patent [19]

Koch et al.

[11] Patent Number: 5,461,957

[45] Date of Patent: Oct. 31, 1995

[54] COLD MEAT SLICER

[75] Inventors: Klaus Koch, Geislingen; Michael Fuchs, Esslingen; Viktor Fecker, Hechingen, all of Germany

[73] Assignee: Bizerba-Werke Wilhelm Kraut GmbH & Co. KG, Balingen, Germany

[21] Appl. No.: 122,584

[22] Filed: Oct. 19, 1993

[30] Foreign Application Priority Data

Apr. 10, 1991 [DE] Germany ..... 41 11 498.8

[51] Int. Cl.[6] ..... B26D 7/06

[52] U.S. Cl. ..... 83/713; 83/356; 83/437; 83/522.12; 83/707

[58] Field of Search ..... 83/703, 707, 355, 83/356, 713, 522.11, 437, 522.12

[56] References Cited

U.S. PATENT DOCUMENTS 3,320,990 5/1967 Anecki ..... 83/713
3,715,946 2/1973 Kaltenbach ..... 83/522.11
4,483,072 11/1984 Nagashima et al. ..... 83/522.12
4,528,488 7/1985 Susemihl ..... 83/522.12
4,813,316 3/1989 Johnson et al. ..... 83/42

FOREIGN PATENT DOCUMENTS 1927520 1/1962 Germany .

*Primary Examiner*—Richard K. Seidel
*Assistant Examiner*—Allan M. Schrock
*Attorney, Agent, or Firm*—Shenier & O'Connor

[57] ABSTRACT

A cold meat slicer having a housing, a rotating circular cutter blade, a carriage for the product to be cut for reciprocating movement relative to the cutter blade and adapted to be driven either manually or by a motor. The optionally selectable manual or motor-driven operation is provided by two parallel rocker arms, a drive arm and a driven arm adapted to be selectively coupled and mounted on a common swivel axis, the drive arm being connected to a drive motor and the driven arm coupled to the carriage guide. The rocker arms execute their movements exclusively in planes parallel to each other.

7 Claims, 4 Drawing Sheets

COLD MEAT SLICER

The invention concerns cold meat slicers comprising a machine housing, a rotating circular cutter blade, a carriage for the product to be cut which is reciprocatingly driven either by hand or by a motor and receives a product to be cut into slices and an adjusting means for selectively switching over between manual and motor-driven operation of the carriage for the product to be cut, whereby the optionally selectable motor-driven operation of the carriage for the product to be cut results by means of two parallel rocker arms, namely a drive arm and a driven arm, adapted to be coupled with each other and pivotally mounted on a common swivel axis, the rocker arms executing their movements exclusively in planes parallel to each other, whereby, in addition, the driven arm is connected with a guide member of the carriage for the product to be cut via a coupler and the drive arm is connected with the motor of the carriage for the product to be cut via crank and coupler members, and a coupling device operable from the outside by way of the adjusting means for switching over between manual and motor-driven operation is provided for the rocker arms, the coupling device comprising a recess on the end face of the drive arm opposite the swivel axis, a locking element displaceable relative to said recess being engageable therein.

A cold meat slicer of this type is known from GB-A-972 465.

In the known cold meat slicer, recognition of whether the machine has been set to manual or motor-driven operation is not clearly realizable. Besides, the known machine has a relatively great constructional height which has a detrimental effect during usage of the machine.

The object of the invention is to improve a cold meat slicer of the generic type according to GB-A-972 465 such that a very flat and compact type of construction as well as easy recognition of manual or motor-driven operation is made possible, so that the machine is practical and safely operable to a great extent during use and that an unintentional motor-driven operation is effectively prevented.

The object of the invention is accomplished in a first embodiment in that the locking element is guided for displacement on the driven arm radial to the swivel axis in a guide within limits, and that one or several position indicators, particularly in the form of an electrical switch, are assigned to the adjusting means, the position indicators supplying one or several identification signals with respect to the set manual or motor-driven operation for electrically controlling the cold meat slicer.

In a further embodiment, the object of the invention is accomplished in that the locking element is securely arranged on the driven arm and the drive arm is capable of executing, in addition to its pivoting motion, a limited displacement in the plane of the pivoting motion, and that one or several position indicators, particularly in the form of electrical switches, are assigned to the adjusting means, the position indicators supplying one or several identification signals with respect to the set manual or motor-driven operation for electrically controlling the cold meat slicer.

The advantages which can be achieved by means of the invention are to be seen particularly in the fact that a very flat type of construction is possible and the drive as well as the coupling device can be manufactured with simple constructional components. A further advantage is to be seen in the fact that a switching lever can be stationarily mounted in the drive housing for easy operation and, thereby, recognition of manual or motor-driven operation, e.g. by means of an electrical switch, is made possible without any difficulties.

The following description of preferred embodiments of the invention serves to explain the invention in greater detail in conjunction with the attached drawings. In these drawings.

Figure 1:
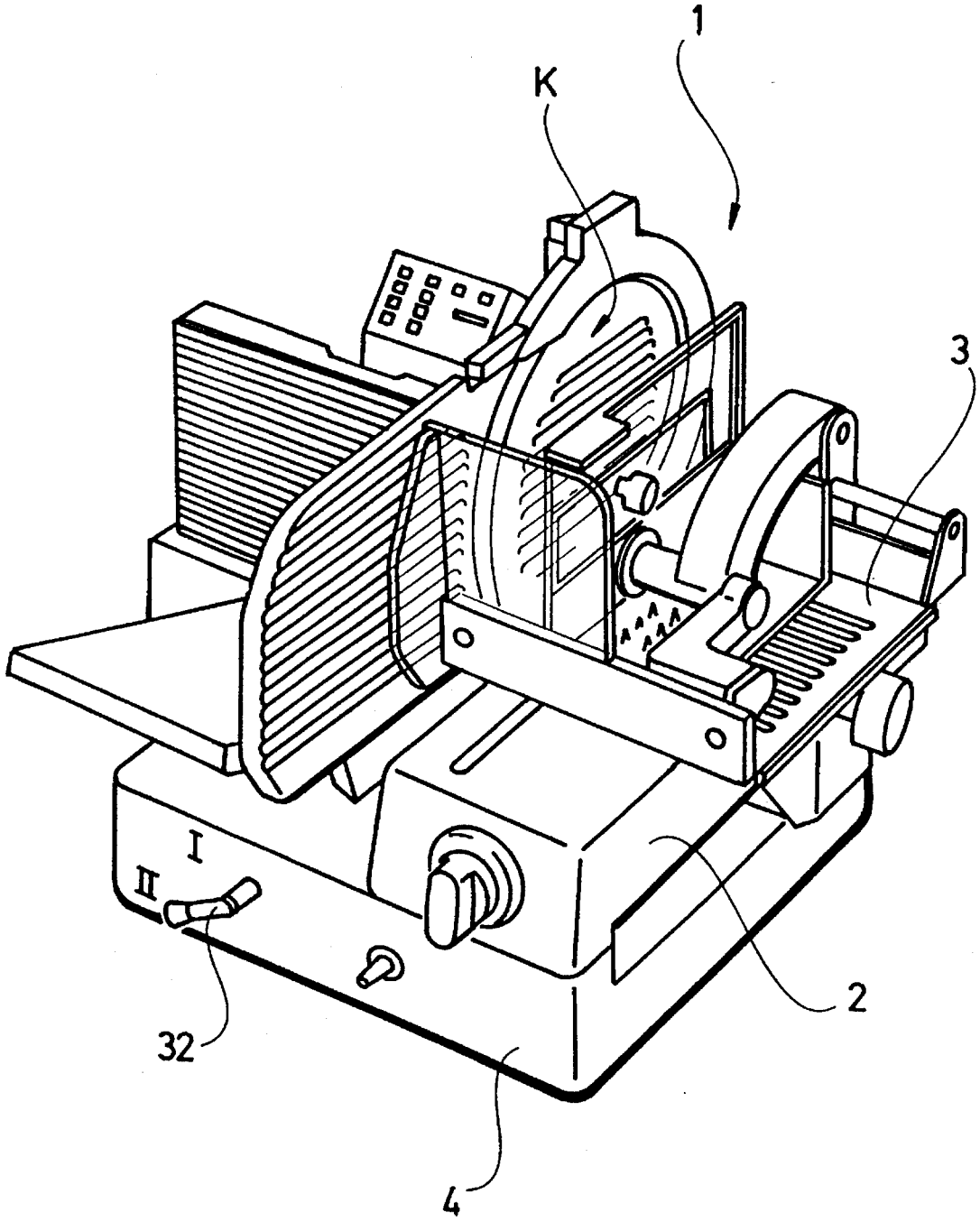
FIG. 1 is a diagrammatic representation of a cold meat slicer according to the invention.
Figure 2:
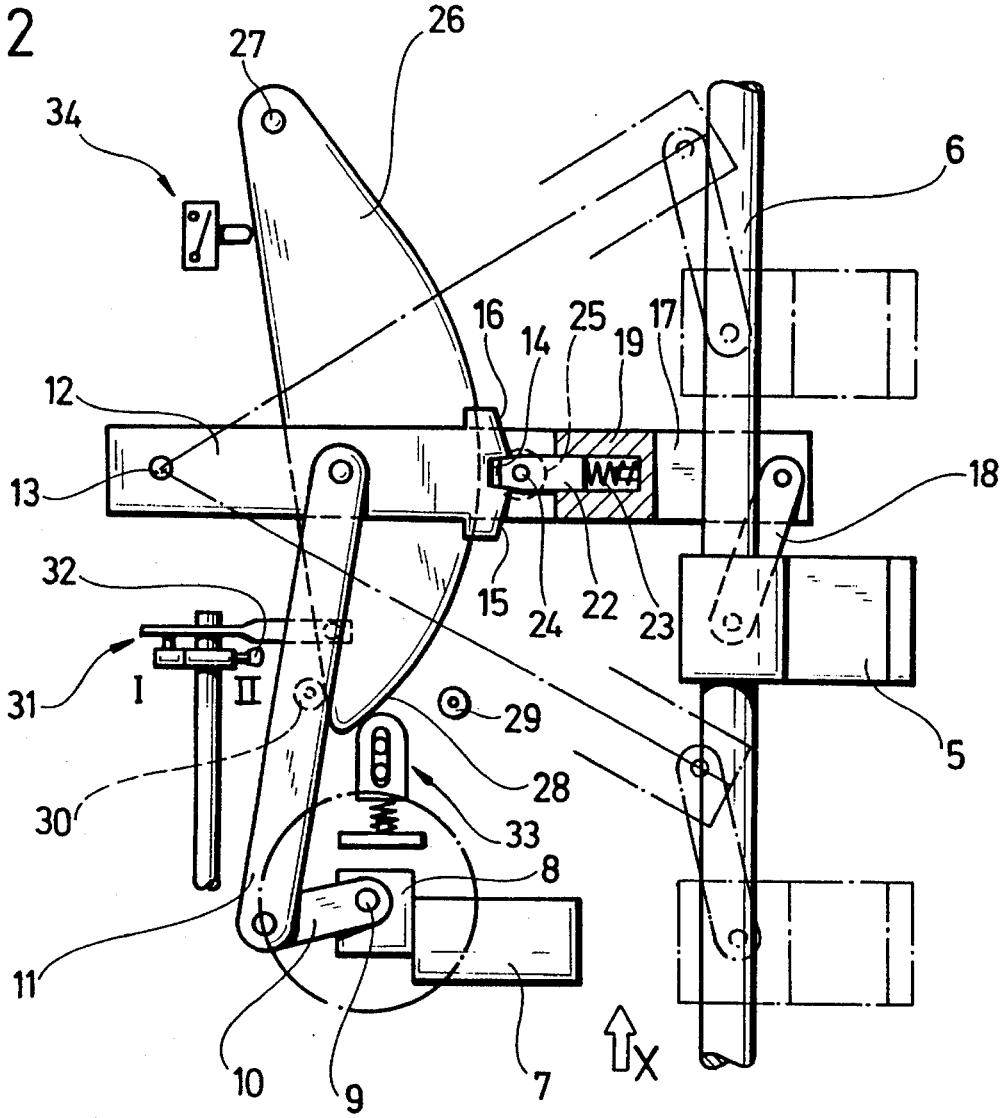
FIG. 2 is a plan view of a coupling device in a coupled position (motor-driven operation)
Figure 3:
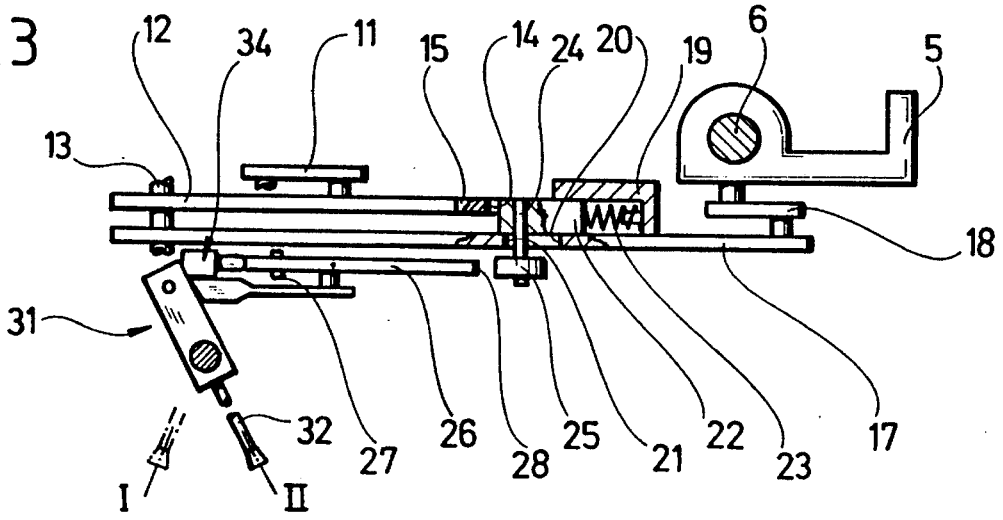
FIG. 3 is a front view of the coupling device from FIG. 2 in the direction of the arrow X in FIG. 2.

A cold meat slicer 1 for optional manual or motor-driven operation comprises in the usual manner a rotating circular cutter blade K and a carriage 3 for the product to be cut guided on a machine housing 2. The drive for the carriage 3 for the product to be cut is accommodated in the drive housing 4. The drive is described in more detail in the following, whereby the housings 2 and 4 are omitted in FIGS. 2 to 8*a*.

The carriage 3 (not illustrated in FIGS. 2 and 3) for the product to be cut is guided by means of a guide member 5 on a guide axis 6 fixed in the machine housing 2. The guide member 5 comprises further constructional elements not illustrated, which prevent a pivoting of the carriage for the product to be cut about the guide axis 6 and only permit a longitudinal movement of the carriage.

The carriage 3 for the product to be cut is driven by an electric motor 7 with a gear unit 8. A crank 10 is attached on a driven shaft 9 of the gear 8 and is connected with a drive arm 12 by means of a coupling member 11 via swivel joints known per se and not described in closer detail.

The drive arm 12 is mounted on an axis 13 fixed in the drive housing 2 and is pivotal in a horizontal plane about this axis. The pivoting movement about the axis 13 is effected by rotation of the drive motor 7 via the gear 8, the driven shaft 9, the crank 10 and the coupling member 11. The drive arm 12 has a recess 14 at its end face as well as abutting surfaces 15 and 16 arranged symmetrically hereto.

A driven arm 17 extending parallel to the drive arm and arranged thereunder is associated with the drive arm 12, and is also mounted on the same axis 13 so as to be horizontally pivotable. The driven arm 17 is articulatedly connected with the guide member 5 via a coupler 18, so that the guide member can be driven back and forth on the guide axis 6 together with the carriage for the product to be cut.

In order to transfer the pivoting movement of the drive arm 12, a locking element 22 which is is displaceably guided on the driven arm 17 in a guide 19 within limits 20 and 21, is assigned to recess 14 of the drive arm and is pressed into the recess 14 by a biasing means in the form of a pressure spring 23.

The locking element 22 is fixedly connected with a rotatable roller 25 via a bolt 24. The roller 25 and with it the locking element 22 can be displaced on the driven arm 17 by means of an associated cam segment 26 in radial direction away from the swivel axis 13 against the force of the spring 23, so that the locking element 22 no longer engages in the recess 14 and, thus, a disengagement takes place. The cam segment 26 is mounted in the drive housing 4 so as to be horizontally pivotable on an axis 27, whereby a guiding curve 28 of the cam segment 26 forms a limited circular path around the swivel axis 13 in the manual operation position as illustrated in FIGS. 4 and 5, and the roller 25 pressed onto the guiding curve 28 by means of the spring 23 runs along this circular path when the driven arm 17 is pivoted.

Two adjustable end stops 29 and 30 installed on the drive housing 4 are assigned to the cam segment 26. The cam segment 26 is brought into its respectively desired end position by means of a mechanical adjusting means 31 not further described and a selection or switching lever 32, and is engaged with a detent element 33 not further described, in the respective end position at the stop 29 or 30 and is hereby secured in its respective position. The switching lever 32 is reciprocatingly pivotable between a position I (manual operation) and a position II (motor-driven operation).

Figure 4:
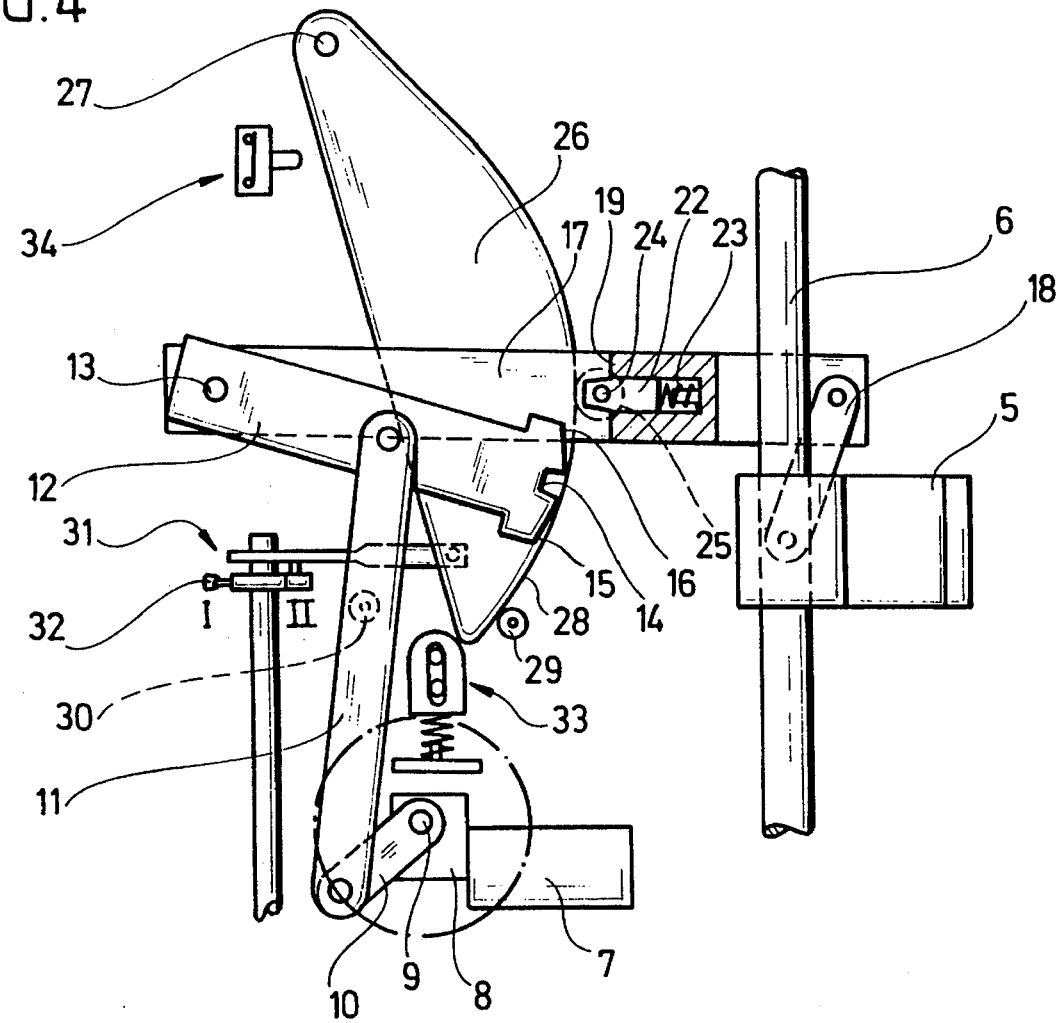
FIG. 4 is a plan view of the coupling device in a disengaged position (manual operation)
Figure 5:
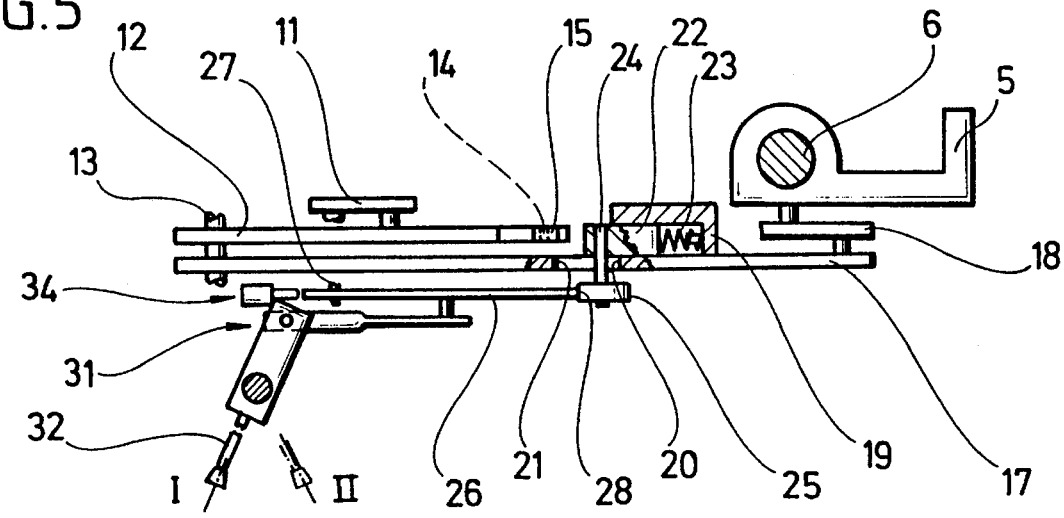
FIG. 5 is a front view of the coupling device from FIG. 4 in the direction of the arrow X.
Figure 6:
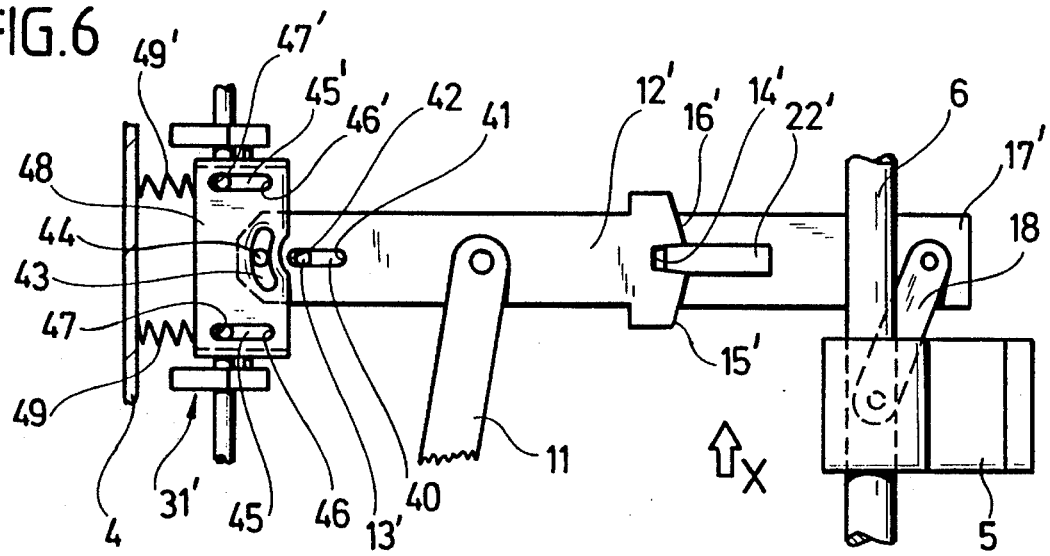
FIG. 6 is a plan view of a further embodiment of a coupling device in an engaged position.

When the cam segment 26 is pivoted against the end stop 29, i.e. into position I (manual operation), the locking element 22 is disengaged from the recess 14 of the drive arm 12 by being pushed back via the roller 25 against the spring 23, as illustrated in FIGS. 4 and 5 and already described above, so that the carriage 3 for the product to be cut can easily be displaced by hand along its guide axis.

When the cam segment 26 is pivoted against the end stop 30—i.e. into position II (automatic or motor-driven operation) of the operation lever 32—the guiding curve 28 of the cam segment 26 is pivoted away from the roller 25, so that the locking element 22 is pushed to its limit 21 by the spring 23. When the rocker arms 12 and 17 are congruent, the locking element 22 engages in the recess 14 so that the driven arm 17 is coupled with the drive arm 12, and the swivel movement of the drive arm 12 produced by the crank drive as described above, is transferred to the driven arm 17 and the carriage 3 is hereby automatically moved to and fro, driven by the motor 7.

When the rocker arms 12 and 17 are in positions different from each other ("crossing over"), the locking element abuts on one of the abutting surfaces 15 or 16 and is pushed back against the action of the spring 23 until the locking element 22 is located in front of the recess 14 as the rocker arms 12, 17 are brought closer together and the locking element is locked into the recess by means of the spring 23.

A position indicator not further described, e.g. an electrical switch 34 (FIG. 2), is assigned to the cam segment 26 or the adjusting means 31, the position indicator being able to transmit an identification signal to the usual electrical machine control. In the "manual operation" or "motor-driven operation" position, the motor 7 is hereby switched on or off according to the choice of the mode of operation.

The recess 14 and the locking element 22 are formed conically at their flanks to facilitate engagement. The formed angle is within the friction angle and is chosen such that the force of the spring 23 associated with the locking element 22 is sufficient to prevent an automatic disengagement (uncoupling).

A further embodiment of the invention is represented in FIGS. 6, 7, 8 and 8*a*. The driven arm 17' is pivotally mounted about an axis 13' and is connected with the guide member 5 of the carriage 3 for the product to be cut via the coupler 18, as in the embodiment represented in FIGS. 2 to 5.

A locking element 22' is fixedly arranged on the driven arm 17'.

The drive arm 12' is connected with the crank assembly 7, 8, 9, 10 via the coupling member 11 as described above and represented in FIGS. 2 to 5. It has a recess 14' corresponding with the locking element 22' as well as abutting surfaces 15' and 16' at the end face.

Furthermore, the drive arm 12' has for the axis 13' a guide 40 in the shape of an elongated slot with limits 41 and 42 instead of a bearing bore. The drive arm 12' is hereby pivotable about the axis 13' as well as radially displaceable within the limits 41 and 42. The drive arm 12' is also connected with the parts 7, 8, 9, 10 of the crank assembly via the coupling member 11 as in the embodiment already described, and has an extension on the side opposite the recess 14', this extension for its part having an arc-shaped recess 43 closed upon itself at the edge.

A roller or a bolt 44 engages in this recess 43 as follower means. The bolt 44 is attached to a guide plate 48 displaceable in guides 45 and 45' in the drive housing 4 within limits 46, 46', 47, 47'. The guide plate 48 is pushed in its guides 45, 45' in the direction of the axis 13' by means of the pressure springs 49 and 49' acting as biasing means and brings the recess 14' of the drive arm 12' into engagement with the locking element 22' of the driven arm 17' via the bolt 44.

In this position, the drive motor 7 is coupled with the driven arm 17' and effects the reciprocating movement of the carriage 3 for the product to be cut during rotation.

By way of an adjusting means 31' not further described (FIG. 8), the guide plate 48 in its guides 45, 45' can be brought into its end position (FIG. 7) located on the side averted from the axis 13' by means of the switching lever 32 against the spring force of the spring 49, 49' or into its end position (FIG. 6) located on the side facing the axis 13' due to the release of the non-positive connection effected by the switching lever 32 via the spring force. A correspondingly arranged detent element 33' (FIG. 8*a*) thereby secures the respective position of the adjusting means 31' in motor-driven or manual operation.

When the guide plate 48 is pushed back against the force of the springs 49 and 49', the drive arm 12' is pulled back via the bolt 44 so that the recess 14' is disengaged from the locking element 22'. In this position (manual operation), the carriage 3 for the product to be cut is freely displaceable by hand on its guide axis 6.

By switching the switching lever 32 back to the "motor-driven operation" position, as already described, the non-positive connection to the guide plate 48 is counteracted and this guide plate is displaced towards the axis 13' by means of the associated springs 49 and 49'.

When the positions of the rocker arms 12' and 17' are congruent, the positive connection between the recess 14' and the locking element 22' is formed hereby.

When the positions are different, the locking element 22' abuts on one of the abutting surfaces 16', 16' when the rocker arms 12' and 17' cross and presses the drive arm 12' back against the action of the springs 49, 49' until the recess 14' is located opposite the locking element 22' and the reciprocal interlocking engagement of the rocker arms 12' and 17' results by means of the springs 49, 49'.

Figure 7:
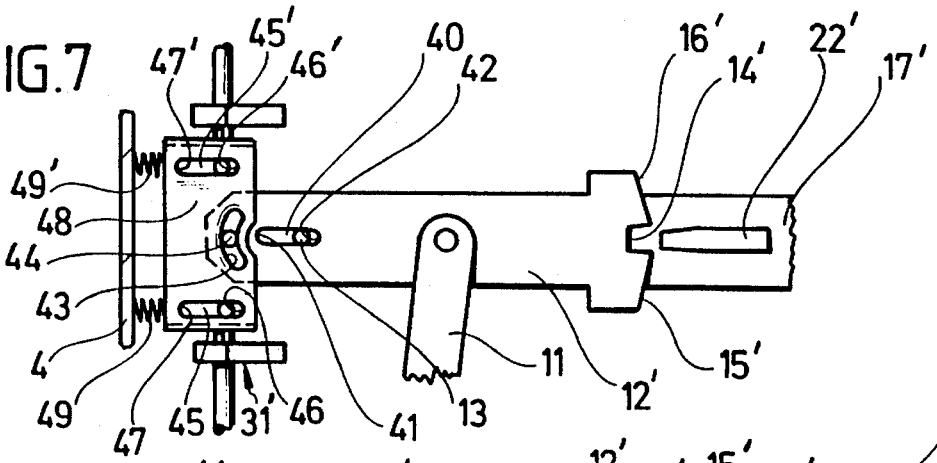
FIG. 7 is a partial plan view similar to FIG. 6 in a disengaged position.
Figure 8:
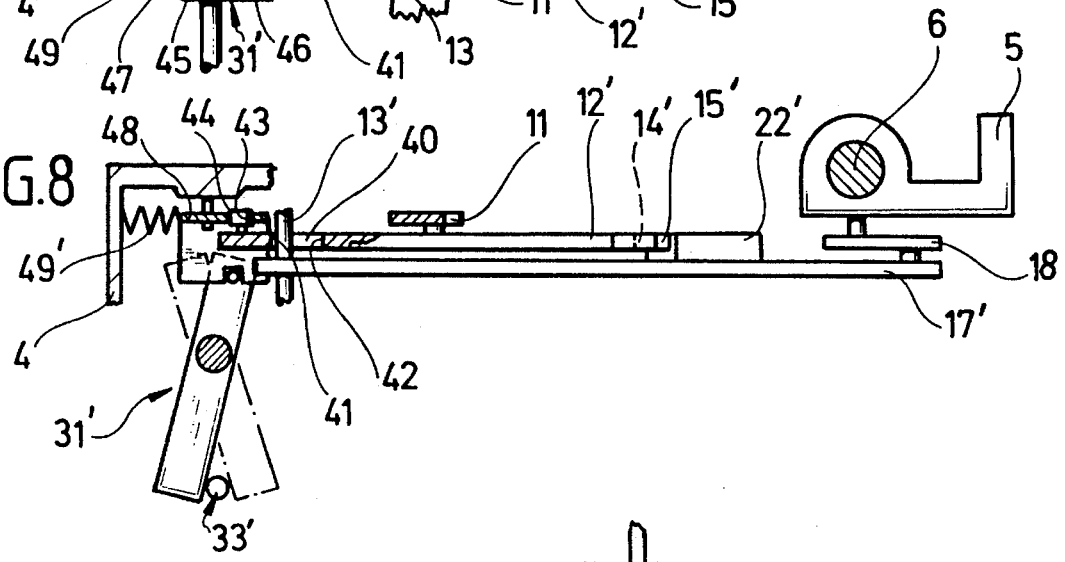
FIG. 8 is a front view of the coupling device from FIG. 6 in the direction of the arrow X in FIG. 6
Figure 8A:
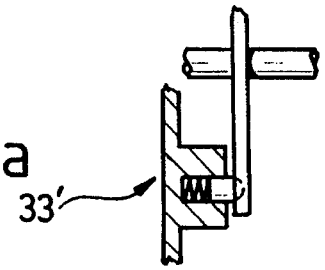
FIG. 8*a* is a detail from FIG. 8 in side view.

On the other hand, a position indicator (switch 34 in FIG. 2) for an identification signal of the positions "manual or motor-driven operation" can also be assigned to this arrangement according to FIGS. 7 to 8*a* at a suitable point.

We claim:

1. A cold meat slicer including in combination a machine housing (2, 4), a rotating cutter blade (K), a carriage (3) for the product to be cut, means mounting said carriage on said housing for reciprocating movement relative to said cutter blade, said carriage adapted to be driven alternatively manually or by a motor, a motor (7) for driving said carriage and adjusting means for selectively switching between manual and motor-driven operation modes of said carriage, said selecting means comprising a drive rocker arm (12) and a driven rocker arm (17) parallel to said drive rocker arm (12), means mounting said rocker arms for pivotal movement around a common swivel axis (13), said rocker arms executing their movements exclusively in planes parallel to each other, said carriage having a guide member (5), a first coupler (18) for connecting said driven arm (17) to said guide member (5), a crank (10) and a second coupler (11) connecting said drive arm (12) to said motor (7), and a coupling means operable by said adjusting means (31) for coupling and uncoupling said rocker arms to switch over between motor-driven and manual operation of said carriage, said coupling means comprising a recess (14) in and end face of the drive arm (12) remote from said swivel axis (13), a locking element (22) displaceable relative to said recess and engageable therein with surface contact and without relative movement in the engaged position thereof, a guide (19) on said driven arm (17) receiving said locking element for displacement radially of said swivel axis (13) and in the planes of movement of the rocker arms between limits (20, 21), said adjusting means comprising a cam segment (26), said coupling means further comprising a roller (25) attached to said locking element (22) and running along said cam segment, a spring (23) for urging said locking element (22) in the direction toward said swivel axis (13) against one of said limits (21), said locking element (22) and said recess (14) being conical at their flanks so that the force of said spring (23) acting on said locking element is sufficient to prevent accidental release, and at least one electrical switch position indicator associated with said adjusting means to provide an indication of the mode of operation of the carriage.

2. Cold meat slicer according to claim 1, characterized in that the cam segment (26) is pivotally mounted on an axis (27) in the machine housing (4) between adjustable end stops (29, 30) for setting the manual or motor-driven operation and is adapted to rest on one of the respective end stops (29, 30) by way of the adjusting means (31).

3. Cold meat slicer according to claim 1, characterized in that the cam segment (26) has a guiding curve (28) for the roller (25), said guiding curve forming an arc about the swivel axis (13) of the rocker arms (12, 17) during manual operation predetermined by the one end stop (29), that a non-positive connection exists between the roller (25) loaded by a spring (23) and said guiding curve (28), and that the locking element (22) is displaceable within a guide (19) by means of the roller (25) against the force of the spring (23).

4. Cold meat slicer according to claim 3, characterized in that the position of the cam segment (26) is chosen such that during manual operation the locking element (22) is completely disengaged from the recess (14) of the drive arm (12) by means of the roller (25).

5. Cold meat slicer according to claim 3, characterized in that during motor-driven operation predetermined by the other end stop (30) the non-positive connection between the guiding curve (28) of the cam segment (26) and the roller (25) is completely counteracted, and that due to the spring (23) forming the biasing means the locking element (22) reaches its end position lying closer to the swivel axis (13) and determined by the limit (21).

6. Cold meat slicer according to any of claim 1, characterized in that the drive arm (12) has abutting surfaces (15, 16) at the end face and symmetrical to the recess (14), the locking element (22) abutting on said surfaces when the rocker arms (12, 17) cross such that said locking element is pushed back by one of the abutting surfaces (15, 16) and locks into the recess (14) when the rocker arms (12, 17) are congruent.

7. Cold meat slicer according to any of claim 1, characterized in that a detent element (33) securing the cam segment (26) in the respectively selected end position is associated with the cam segment (26).

* * * * *